US006734366B2

(12) United States Patent
Kikuchi et al.

(10) Patent No.: US 6,734,366 B2
(45) Date of Patent: May 11, 2004

(54) OVERHEAD CABLE

(75) Inventors: Naoshi Kikuchi, Nikko (JP); Tamezo Suzuki, Ihara (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 09/727,070

(22) Filed: Nov. 29, 2000

(65) Prior Publication Data

US 2001/0017219 A1 Aug. 30, 2001

(51) Int. Cl.[7] ..... H01B 5/08
(52) U.S. Cl. ..... 174/128.1; 174/42
(58) Field of Search ..... 174/128.1, 128.2, 174/129 R, 133 R, 102 R, 106 R, 40 R, 40 TD, 42

(56) References Cited

U.S. PATENT DOCUMENTS 5,711,143 A * 1/1998 Munakata et al. ..... 57/215

FOREIGN PATENT DOCUMENTS

| | | | |
|---|---|---|---|
| JP | 57-46166 | | 10/1982 |
| JP | 5-6765 | | 2/1993 |
| JP | 7-34328 | | 4/1995 |
| JP | 08050814 A | | 2/1996 |
| JP | 10-100506 | * | 2/2001 |

* cited by examiner

*Primary Examiner*—Chau N. Nguyen
(74) *Attorney, Agent, or Firm*—Knobbe Martens Olson & Bear LLP

(57) ABSTRACT

An overhead cable is provided that comprises a tension-bearing core of twisted steel strands, a conductive layer of aluminum strands arranged at the outer circumference of the twisted steel strands, and an outermost layer arranged at the outer circumference of the aluminum strands. The outermost layer is formed by twisting together a plurality of adjoining segment strands. A spiral groove is provided in the longitudinal direction along the boundary portion of the outer circumferential surface of each adjoining segment strand. Along the contour of a cross-section of this outermost layer, each groove comprises an arc-shaped curve having a radius R centered around a vertex of a regular polygon. Each part between adjoining grooves comprises an arc-shaped curve which is concave with respect to a straight line connecting adjoining of a regular polygon, intersecting the arc-shaped curve with radius R.

12 Claims, 11 Drawing Sheets

OVERHEAD CABLE

BACKGROUND OF THE INVENTION

1. Field of the Invention

The present invention relates to an overhead cable designed to reduce the wind load.

2. Description of the Related Art

As an overhead cable of the related art, much use is made of a steel-reinforced aluminum cable (ACSR) comprised of aluminum strands twisted together along the longitudinal direction around a steel core. As such an overhead cable designed to reduce the wind load of the overhead cable, as shown in FIG. 1, a cable obtaining by twisting together aluminum strands 2 on a steel core 1, twisting together segment strands 3 along the longitudinal direction having a sector-form cross-section at the outermost layer, forming the corners of each segment strands 3 as arc surfaces, and preventing the tangent of the arc of the intersection of the adjoining abutting surfaces of the segment strands 3 and the arc of the corners from passing through the center of the cable by setting the radius of curvature of the corner arc surface to a specific value and thereby reduce the wind load is disclosed in Japanese Examined Patent Publication (Kokoku) No. 57-46166.

As another overhead cable designed to reduce the wind load, an overhead cable obtained by setting the height of projections of spiral strands wound over an envelope of the outermost layer strands and the center angles of the projections to specific values so as to reduce the wind load is disclosed in Japanese Examined Patent Publication (Kokoku) No. 5-6764.

As still another overhead cable designed to reduce the wind load, an overhead cable obtained by making the surface of the outermost layer a wavy shape so as to reduce the wind load is disclosed in Japanese Examined Patent Publication (Kokoku) No. 7-34328.

These overhead cables above mentioned can give effect of reducing the wind load.

Other type of overhead cable designed to reduce the wind load is disclosed in Japanese Unexamined Patent Publication (Kokai) No. 8-50814.

The overhead cable disclosed in the publication, as shown in FIG. 2, is an overhead cable obtained by twisting together aluminum strands 2 on a steel core 1 along the longitudinal direction, twisting together segment strands 3 having a sector-form cross-section at the outermost layer and providing arc-shaped grooves 4 at the front surface of the adjoining parts of the segment strands.

This overhead cable has a circular sectional shape as its basic shape. It is formed with arc-shaped grooves in its front surface. The swirl created inside the grooves causes the breakaway point of the flow to move to the downwind side of the overhead cable and thereby reduces a drag coefficient Cd.

The overhead cable disclosed in Japanese Unexamined Patent Publication (Kokai) No. 8-50814 gave the effect of reducing the wind load when the diameter of the overhead cable was relatively large, but had the disadvantage that when the diameter of the overhead cable became small, the Reynolds number Re fell and, due to the relation of this lowered Reynolds number Re and the drag coefficient Cd, the wind speed zone in which the drag coefficient Cd was lowered became remarkably high. For this reason, in an overhead cable having a small diameter, for example, a diameter of 25 mm or less, the design wind speed at which the drag coefficient Cd fell became 60 to 70 m/s, which was not practical.

SUMMARY OF THE INVENTION

An object of the present invention is to provide an overhead cable designed to reduce the wind load acting upon the overhead cable in a lower wind speed zone even in a cable having a relatively small diameter.

According to the present invention, there is provided an overhead cable comprising: an outermost layer constituted by twisting together a plurality of segment strands, and having a spiral groove along the longitudinal direction in the outer circumferential surface region of each boundary portion of adjoining segment strands, wherein in the contour of the cross-section of said outermost layer, each groove comprises an arc-shaped curve having a predetermined radius R centered about a vertex of a regular polygon and each part between adjoining grooves comprises a straight line or a curve which is concave with respect to said straight line.

In the overhead cable of the present invention, the fluctuation in pressure created at the cable surface depends upon the shape of the polygon and the fluctuations in pressure are made to occur at the vertexes of the polygon. As a result, the distribution of speed inside a laminar flow boundary layer collapsed to cause turbulence at an early stage and therefore increase the speed in the bottom of the boundary layer.

For this reason, the breakaway point of the flow moves to the back flow side, a back flow zone of the cable is reduced, a negative pressure area generated downwind of the cable is reduced, and therefore the drag becomes smaller.

BRIEF DESCRIPTION OF THE DRAWINGS

The above object and features of the present invention will be more apparent from the following description given with reference to the accompanying drawings, wherein.

DESCRIPTION OF THE PREFERRED EMBODIMENTS

Figure 1:
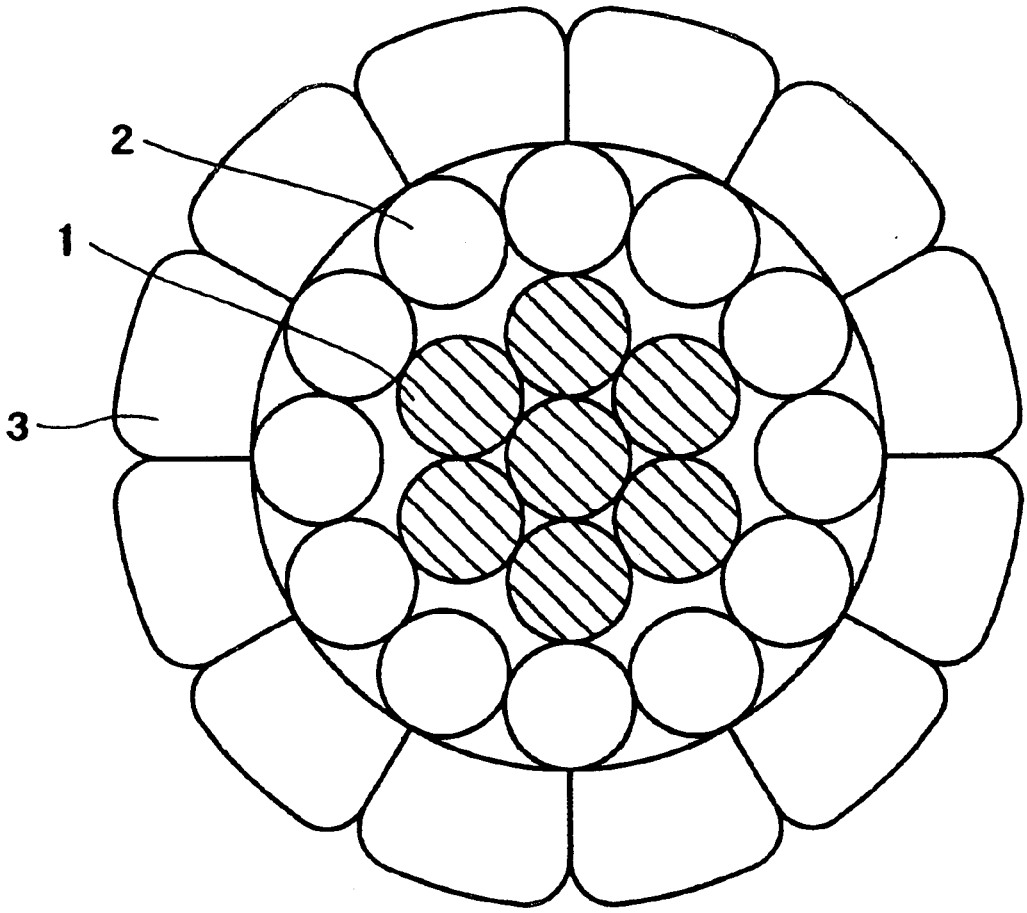
FIG. 1 PRIOR ART
FIG. 1 is a sectional view of an example of the sectional structure of a reduced wind load overhead cable of the related art.
Figure 2:
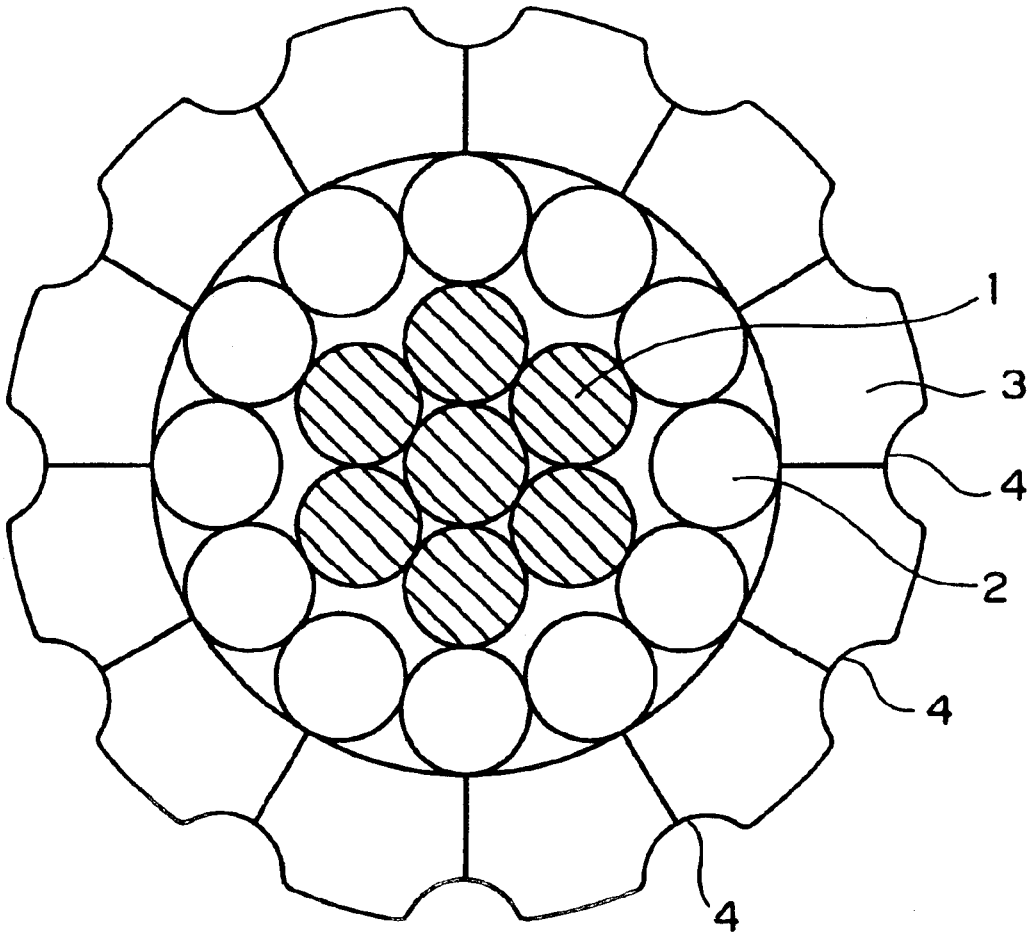
FIG. 2 PRIOR ART
FIG. 2 is a sectional view of other example of the sectional structure of a reduced wind load overhead cable of the related art.

Below, embodiments of the present invention will be explained by referring to the drawings.

Figure 3:
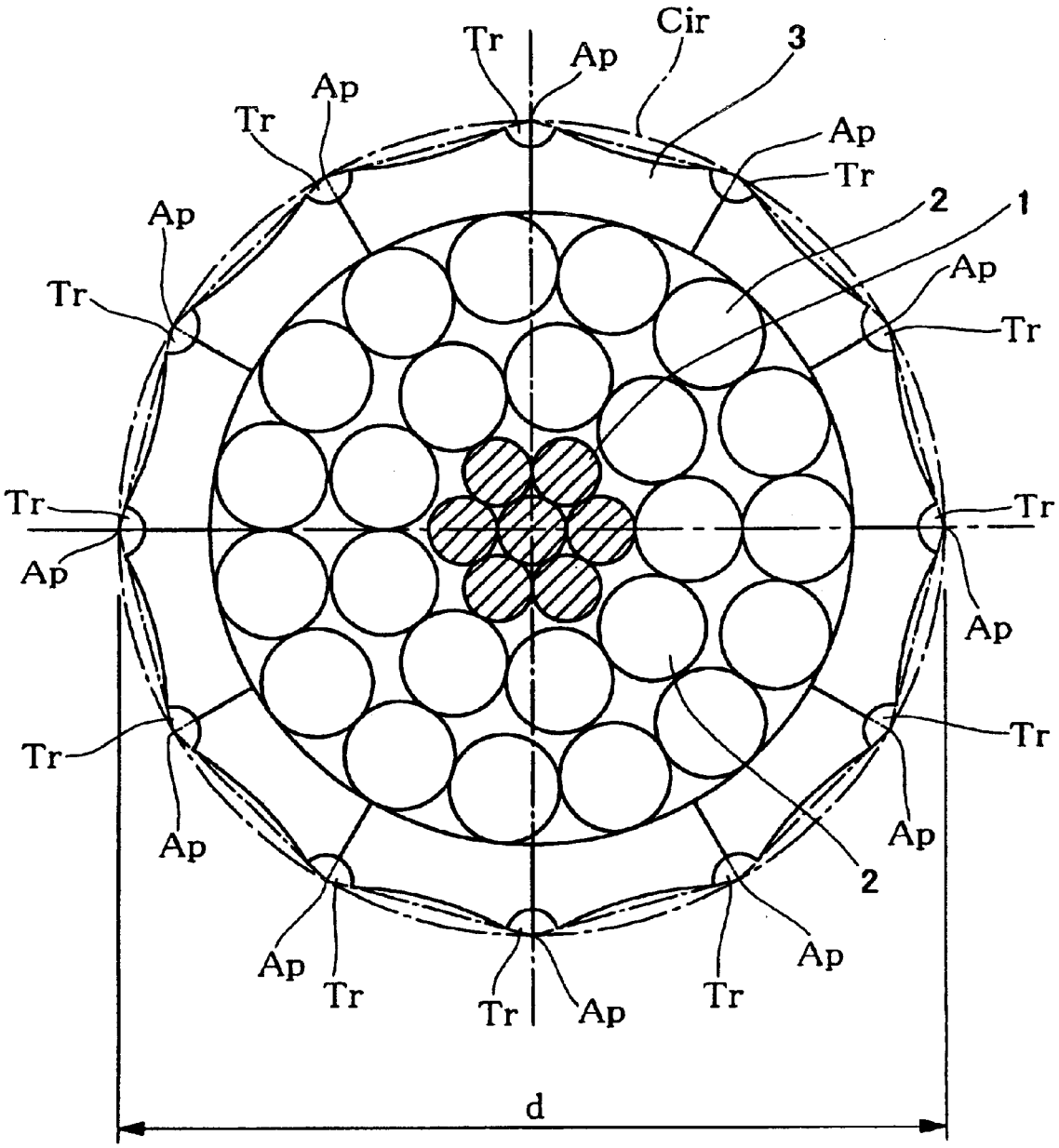
FIG. 3 is a sectional view of an embodiment of an overhead cable according to a first aspect of the present invention.

FIG. 3 is a sectional view of an embodiment of an overhead cable according to the present invention.

This overhead cable is comprised of seven steel strands 1 serving as the tension-bearing core, 24 aluminum strands 2 serving as the conductive layer twisted around them, and a further 12 segment strands 3 having sector-form cross-sections serving as the outermost layer twisted around these strands.

In the outer circumferential surface area of each boundary of adjoining segment strands 3, a groove Tr extending along the longitudinal direction is formed.

Figure 4:
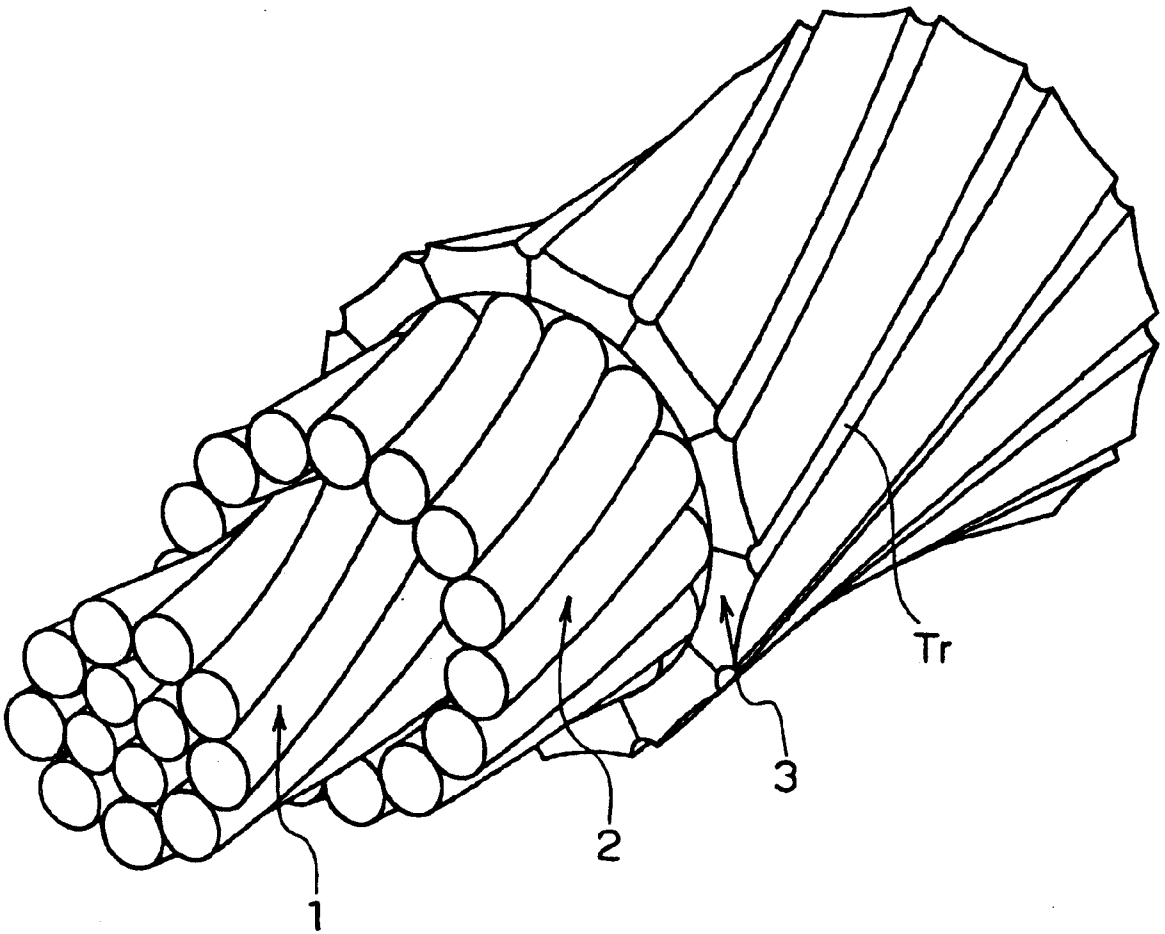
FIG. 4 is a perspective view of the state of the steel strands, the aluminum strands and the segment strands twisted together.

FIG. 4 is a perspective view of the state of the steel strands, the aluminum strands and segment strands twisted together.

As seen from FIG. 4, the groove Tr is formed into a spiral-form.

In the outer circumferential contour of the cross-section of each of the 12 segment strands 3 having the sector-form cross-sections serving as the outermost layer, the contour of the groove Tr described above is comprised by an arc-shaped curve having a predetermined radius R centered around a vertex Ap of a regular 12-sided polygon.

Further, the outer circumferential contour shape of each part between adjoining grooves Tr is comprised by an arc-shaped curve which is concave with respect to a straight line connecting adjoining vertexes Ap of the regular 12-sided polygon and intersects the arc-shaped curve having the predetermined radius R described above.

The diameter d of a circle Cir circumscribing the vertexes Ap of the regular 12-sided polygon is set to a value in a predetermined range in order to obtain the effect of reducing the wind load even at a relatively low design wind speed of about 40 m/s and is preferably set within the range from 12.8 to 42.6 mm.

Figure 5:
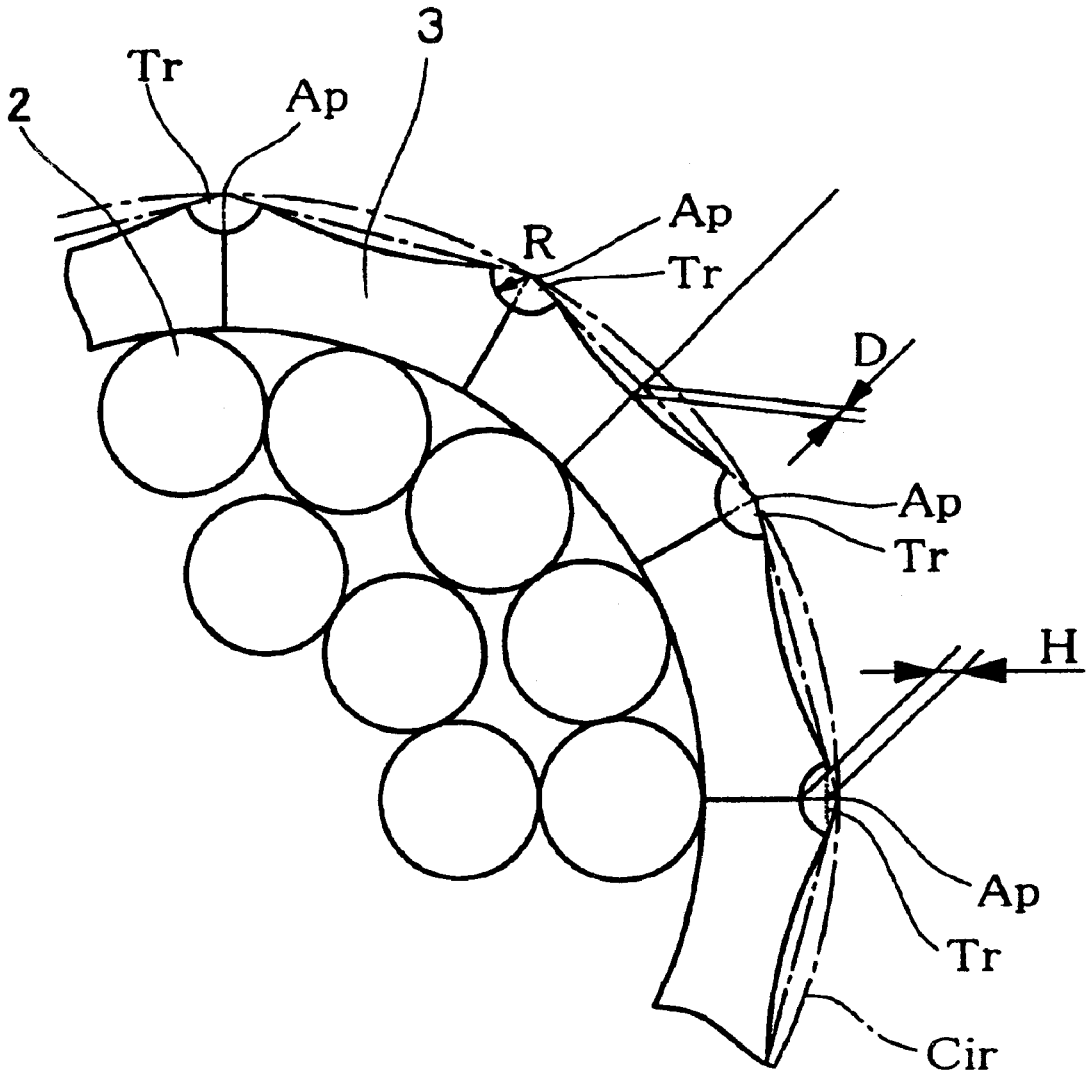
FIG. 5 is an enlarged sectional view of a principal part of the overhead cable shown in FIG. 3.

Here, FIG. 5 is an enlarged sectional view of a principal part of the overhead cable shown in FIG. 3.

In FIG. 5, if the maximum depth of the arc-shaped curve which is concave with respect to the straight line connecting adjoining vertexes Ap of the regular 12-sided polygon from the related straight line is defined as D, this maximum depth D is set in a predetermined range with respect to the diameter d of the circle Cir circumscribing the vertexes Ap of the regular 12-sided polygon in order to obtain the effect of reducing the wind load. Preferably, the ratio D/d of the maximum depth D and the diameter d is within the range from 0.0 to 0.018.

In FIG. 5, if the maximum height from each vertex Ap of the regular 12-sided polygon to the bottom of the groove Tr is defined as H, this maximum height H is set to a value in a predetermined range with respect to the diameter d of the circle Cir in order to obtain the effect of reducing the wind load. Preferably, the ratio H/d between the maximum height H and the diameter d is within a range from 0.0045 to 0.0357.

Also, the maximum height H from a vertex Ap to the bottom of the groove Tr is set to a value in a predetermined range with respect to the radius R of the groove Tr in order to obtain the effect of reducing the wind load. Preferably, the ratio H/R between the maximum height H and the radius R is within the range from 0.08 to 1.0.

Further, in FIG. 3 and FIG. 5, the case where the number of the segment strands 3 constituting the outermost layer was set at 12 was shown, but in the present invention, the number of the segment strands 3 is not limited to 12. Preferably, the number of the segment strands 3 is selected within a range from 12 to 24.

In the overhead cable according to the present embodiment having the above sectional structure, when the wind strikes this overhead cable, the wind forms a thin boundary layer along the outer circumferential surface of the segment strands 3. This boundary layer is greatly agitated in the grooves Tr when passing through the grooves Tr and becomes turbulence. The breakaway point of the boundary layer can be moved backward to the downwind side of the segment strands 3 by the action of the grooves Tr making the flow turbulent and thus a wind load reducing effect is obtained.

In addition to the action of the grooves Tr, in the overhead cable according to the present embodiment, the basic contour shape of the segment strands 3 constituting the outermost layer is made not a circle, but a regular polygon, therefore the turbulence of the boundary layer is further promoted by the action of the shape of this regular polygon and the breakaway point of the boundary layer can be further moved backward on the downwind side of the segment strands 3 and therefore a further wind load reducing effect is obtained.

Further, in the overhead cable according to the present embodiment, a recess having a maximum depth D is formed in the outer circumferential surface of each segment strand 3 constituting the outermost layer, therefore a further wind load reducing effect is obtained by the action of the recesses on the boundary layer.

Figure 6:
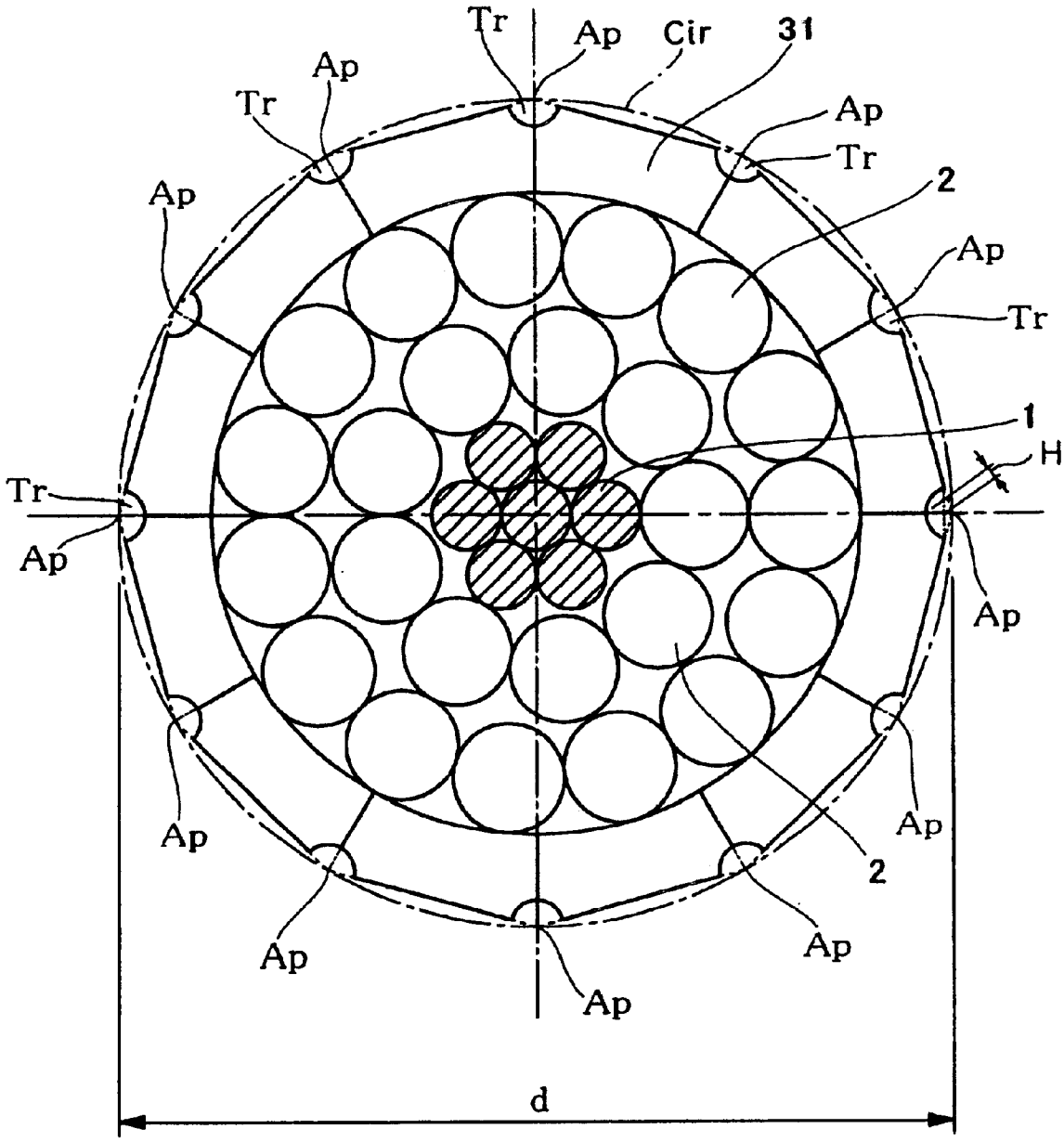
FIG. 6 is a sectional view of an embodiment of an overhead cable according to a second aspect of the present invention.

FIG. 6 is a sectional view of other embodiment of an overhead cable according to the present invention.

Note that the same references are assigned to the same constituent parts as those of the overhead cable shown in FIG. 3.

The overhead cable shown in FIG. 6 is comprised of seven steel strands 1 serving as the tension-bearing core, 24 aluminum strands 2 serving as the conductive layer twisted together around their outer circumference, and a further 12 segment strands 31 having fan-shaped cross-sections serving as the outermost layer twisted together at that outer circumference.

In the outer circumferential surface area of each boundary of adjoining segment strands 31, a spiral groove Tr extending along the longitudinal direction is formed.

In the outer circumferential contour of the cross-section of each of the 12 segment strands 31 having the fan-shaped cross-sections serving as the outermost layer, the contour of the groove Tr described above is comprised by an arc-shaped curve having a predetermined radius R centered around a vertex Ap of a regular 12-sided polygon.

Further, the outer circumferential contour of each part between adjoining grooves Tr is comprised by a line segment located on a straight line connecting adjoining vertexes Ap of the regular 12-sided polygon described above and intersecting the arc-shaped curves of the grooves Tr.

Namely, the outer circumferential contour of the cross-sections of the 12 segment strands 31 having the sector-form cross-section serving as the outermost layer are comprised by the sides of the regular 12-sided polygon and the concave arc-shaped curves arranged at the vertexes.

The diameter d of the circle Cir circumscribing the vertexes Ap of the regular 12-sided polygon is set at a value in a predetermined range in order to obtain the effect of reducing the wind load even at the relatively low design wind speed of about 40 m/s. Preferably, it is set within a range from 12.8 mm to 42.6 mm.

Also, if the maximum height from each vertex Ap of the regular 12-sided polygon to the bottom of the groove Tr is defined as H, this maximum height H is set to a value in a predetermined range with respect to the diameter d of the circle Cir in order to obtain the effect of reducing the wind load. Preferably, the ratio H/d between the maximum height H and the diameter d is within the range from 0.0045 to 0.0357.

Further, the maximum height H from each vertex Ap to the bottom of the groove Tr is set to a value in the predetermined range with respect to the radius R of the groove Tr in order to obtain the effect of reducing the wind load. Preferably, the ratio H/R between the maximum height H and the radius R is within the range from 0.08 to 1.0.

Furthermore, in FIG. 6, the case where the number of the segment strands 31 constituting the outermost layer was set at 12 was shown, but in the present invention, the number of the segment strands 31 is not limited to 12. Preferably, the number of the segment strands 31 is selected within the range from 12 to 24.

In the overhead cable according to the present embodiment, the point that a recess is not formed in the outer circumferential surface of each segment strand 31 is the point of difference from the overhead cable according to the first aspect of the present invention.

Accordingly, except for the action of the recess of the outer circumferential surface of each segment strand 31, a wind load reducing effect is obtained by a similar action to that of the overhead cable according to the first aspect of the present invention described above.

FIGS. 7 to 11 are graphs showing the results of wind tunnel experiments conducted to study the drag reduction characteristics for overhead cables having various structures, in which abscissas represent the wind speed (m/s) and the ordinates represent the drag coefficient Cd. Note that the wind speed (m/s) was measured within a range from 10 m/s to 80 m/s since the highest wind speed used at the design of an ordinary overhead power transmission line is 40 m/s. Further, as the overhead cable, use was made of the following steel-reinforced aluminum cables having diameters of 22 to 36.6 mm. The experiments were also conducted on conventional steel-reinforced aluminum cables (ACSR) for comparison (ones obtained by twisting together a plurality of strands having a circular cross-section).

1.810 $mm^2$ class

Cable 1 of present invention: d=36.6 mm, 12 outermost layer segment strands, D=0.3 mm, R=1.0 mm, H=1.0 mm.

Cable 2 of present invention: d=36.6 mm, 12 outermost layer segment strands, D=0.3 mm, R=2.0 mm, H=0.3 mm.

Cable 3 of present invention: d=36.6 mm, 20 outermost layer segment strands, D=0.1 mm, R=0.75 mm, H=0.6 mm.

Cable 4 of present invention: d=36.6 mm, 20 outermost layer segment strands, D=0.1 mm, R=1.5 mm, H=0.75 mm.

Cable 5 of related art (ACSR): d=38.4 mm.

2.610 $mm^2$ class

Cable 6 of present invention: d=33 mm, 16 outermost layer segment strands, D=0.15 mm, R=0.9 mm, H=0.9 mm.

Cable 7 of present invention: d=33 mm, 16 outermost layer segment strands, D=0.15 mm, R=1.8 mm, H=0.26 mm.

Cable 8 of related art (ACSR): d=34.2 mm.

3.410 $mm^2$ class

Cable 9 of present invention: d=28 mm, 14 outermost layer segment strands, D=0.15 mm, R=0.75 mm, H=0.75 mm.

Cable 10 of present invention: d=28 mm, 14 outermost layer segment strands, D=0.15 mm, R=1.5 mm, H=0.22 mm.

Cable 11 of present invention: d=28 mm, 24 outermost layer segment strands, D=0.05 mm, R=1.25 mm, H=1.0 mm.

Cable 12 of present invention: d=28 mm, 24 outermost layer segment strands, D=0.05 mm, R=2.0 mm, H=1.5 mm.

Cable 13 of related art (ACSR): d=28.5 mm.

4.240 $mm^2$ class

Cable 14 of present invention: d=22 mm, 14 outermost layer segment strands, D=0.1 mm, R=0.6 mm, H=0.6 mm.

Cable 15 of present invention: d=22 mm, 14 outermost layer segment strands, D=0.1 mm, R=0.9 mm, H=0.26 mm.

Cable 16 of present invention: d=22 mm, 14 outermost layer segment strands, D=0.1 mm, R=1.25 mm, H=0.1 mm.

Cable 17 of present invention: d=22 mm, 16 outermost layer segment strands, D=0.0 mm, R=1.2 mm, H=0.17 mm.

Cable 18 of present invention: d=22 mm, 16 outermost layer segment strands, D=0.1 mm, R=1.2 mm, H=0.17 mm.

Cable 19 of present invention: d=22 mm, 16 outermost layer segment strands, D=0.2 mm, R=1.2 mm, H=0.17 mm.

Cable 20 of present invention: d=22 mm, 16 outermost layer segment strands, D=0.4 mm, R=1.2 mm, H=0.17 mm.

Cable 21 of related art (ACSR): d=22.4 mm.

Figure 7:
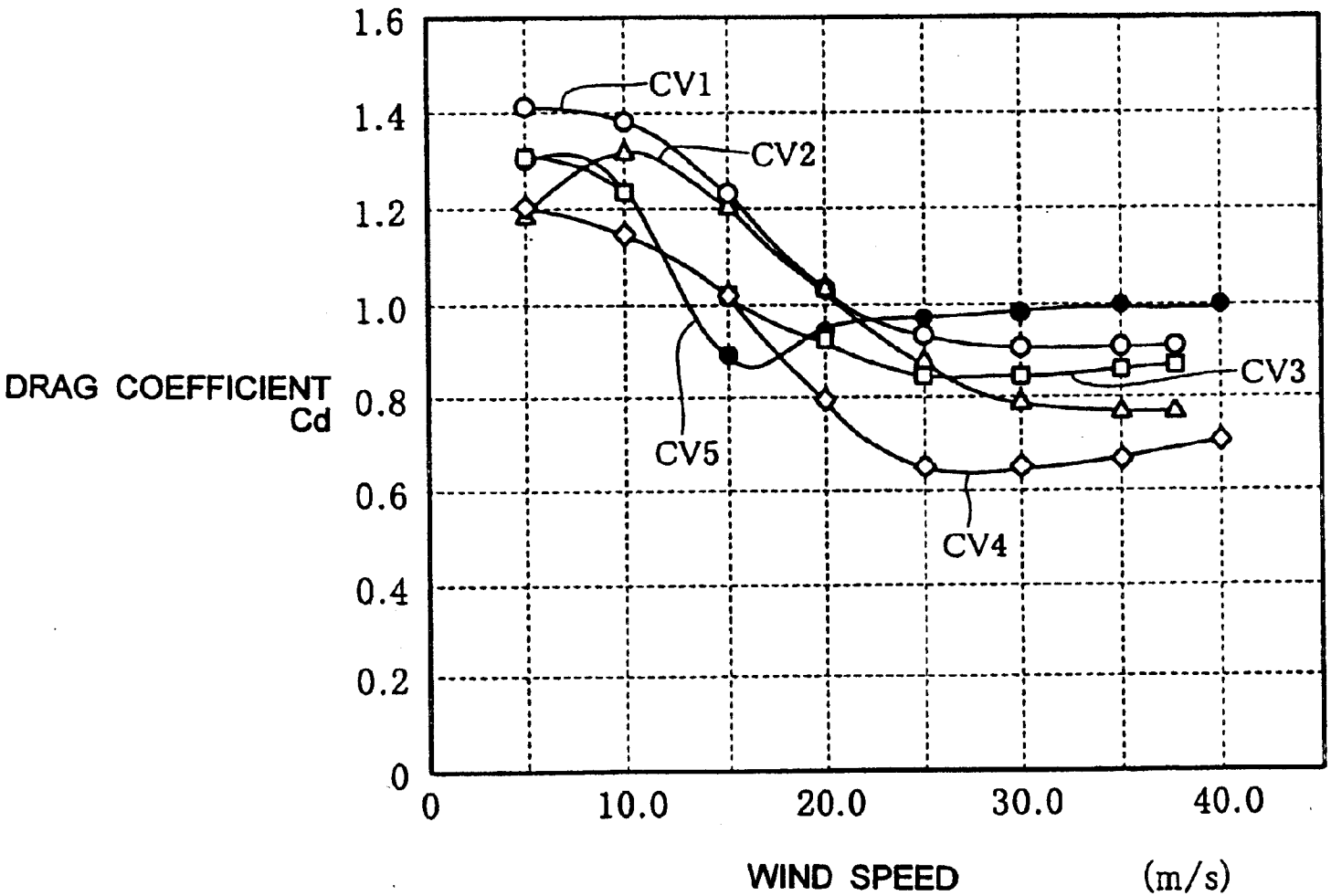
FIG. 7 is a graph of a drag coefficient characteristic of an overhead cable of the present invention and an overhead cable of the related art according to the results of a wind tunnel experiment.

FIG. 7 is a graph of the results of wind tunnel experiments conducted to study the drag reduction characteristics up to the wind speed 40 m/s for the cable 1 to the cable 5.

When investigating the drag coefficient Cd in FIG. 7, in the cable 5 of the related art, as represented by the curve CV5, the drag coefficient Cd reaches a minimum value around the wind speed 16 m/s. Thereafter, when the wind speed becomes higher, the drag coefficient Cd is somewhat increased. At the wind speed 40 m/s, the drag coefficient Cd becomes almost 1.

On the other hand, in the cable 1 of the present invention, as represented by the curve CV1, in the region lower than the wind speed of about 25 m/s, the drag coefficient Cd is higher than that of the cable 5 of the related art, but in the region exceeding the wind speed 25 m/s, the drag coefficient Cd is reduced from that of the cable 5 of the related art, and the drag coefficient Cd becomes about 0.9 or about 90% of that of the cable 5 of the related art.

Similarly, in the cable 2 of the present invention, as represented by the curve CV2, the coefficient becomes about 0.78 when the wind speed is 40 m/s or about 78% of that of the cable 5 of the related art. In the cable 3 of the present invention, as represented by the curve CV3, the coefficient becomes about 0.88 when the wind speed is 40 m/s or about 88% of that of the cable 5 of the related art. In the cable 4 of the present invention, as represented by the curve CV4, the drag coefficient Cd reaches a minimum value of about 0.65 when the wind speed is 25 to 30 m/s and becomes about 70% of that of the cable 5 of the related art when the wind speed is 40 m/s.

As seen from these results, when the cables 1 to 4 of the present invention are used, the design strength of the towers and other supports for overhead cables can be reduced and there is therefore a remarkable economical effect.

When comparing the cable 1 and cable 2 of the present invention and the cable 3 and cable 4, both of each have different design values of the maximum height H of the groove Tr and the radius R of the groove Tr. It is seen that when these design values are different, a difference is created in the effect of reduction of the drag coefficient Cd. Namely, it is seen that the maximum height H and the radius R of the groove Tr are factors exerting an influence on the effect of reduction of the drag coefficient Cd.

Further, as seen from the curve CV1 to the curve CV4, if the ratio H/R is large such as 1.0, the effect of reduction of the drag coefficient Cd is decreasing when the wind speed is within a range from 30 m/s to 40 m/s. Also, as the drag coefficient is more reduced, the ratio H/R becomes smaller than 1.0.

Especially, when comparing the cable 2 and the cable 4, it is clearly seen the effect of reduction of the drag coefficient Cd at the wind speed within a range from 30 m/s to 40 m/s is obtained.

From these results, in a cable having a diameter of about 35 mm to 38 mm, it is seen that the effect of reduction of the drag coefficient is especially large if the ratio H/R is less than about 0.2 in case that the number of the segment strands is 12 and the ratio H/R is less than about 0.6 in case that the number of the segment strands is 20.

Figure 8:
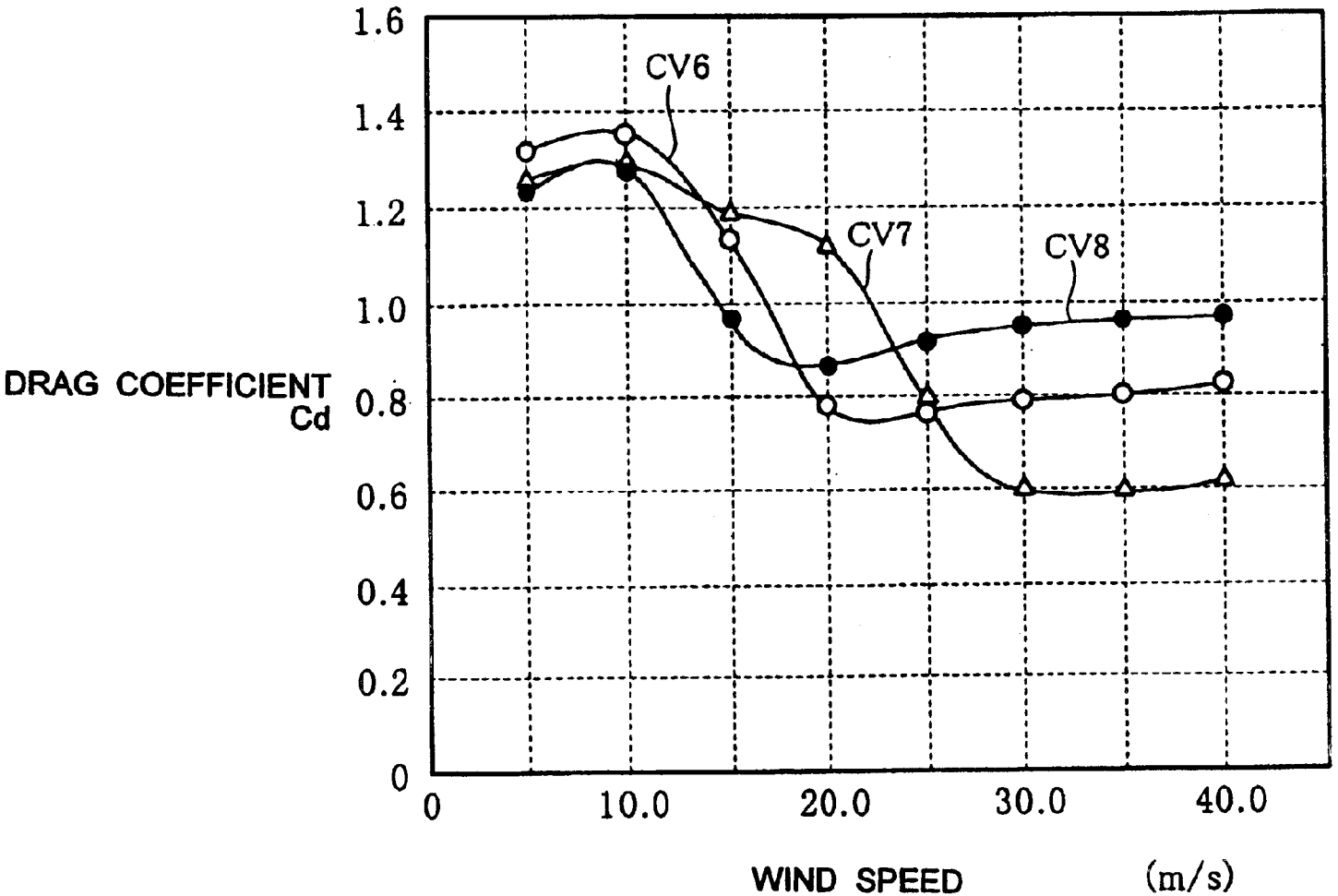
FIG. 8 is a graph of a drag coefficient characteristic of an overhead cable of the present invention and an overhead cable of the related art according to the results of a wind tunnel experiment.

FIG. 8 is a graph of the results of wind tunnel experiments conducted to study the drag reduction characteristics up to the wind speed 40 m/s for the cable 6 to the cable 8.

When investigating the drag coefficient Cd in FIG. 8, in the cable 8 of the related art, as represented by the curve CV8, the drag coefficient Cd reaches a minimum value around the wind speed 20 m/s. Thereafter, when the wind speed becomes higher, the drag coefficient Cd is somewhat increased. At the wind speed 40 m/s, the drag coefficient Cd becomes almost 0.95.

On the other hand, in the cable 6 and the cable 7 of the present invention, as represented by the graphs CV6 and CV7, it is seen that, in the region in which the wind speed exceeds 25 m/s, the drag coefficient Cd is lowered compared with the cable 8 of the related art in the two and the effect of reduction of the drag coefficient Cd is obtained.

Namely, even if the diameter d of the cable becomes small, i.e., 33 mm, in the region in which the wind speed exceeds 25 m/s, the effect of reduction of the drag coefficient Cd is obtained.

Further, when comparing the drag coefficients Cd of the cable 6 and the cable 7, only the design values of the radius R and the maximum height H differ between the two, but it is seen that the characteristics of reduction of the drag coefficient Cd differ considerably according to these design values. Namely, it is seen that the wind speed zone in which the drag coefficient Cd is reduced varies according to these design values.

Further, when the wind speed is within a range from 30 m/s to 40 m/s, as seen from the graph CV6 and CV7, the larger effect of reduction of the drag coefficient Cd is obtained the value of H/R becomes smaller.

From this result, in a cable having a diameter of about 32 mm to 34 mm, it is seen that the effect of reduction of the drag coefficient Cd at the wind speed within a range from 30 m/s to 40 m/s is especially large if the ratio H/R is less than about 0.4 in case that the number of the segment strands is 16.

Figure 9:
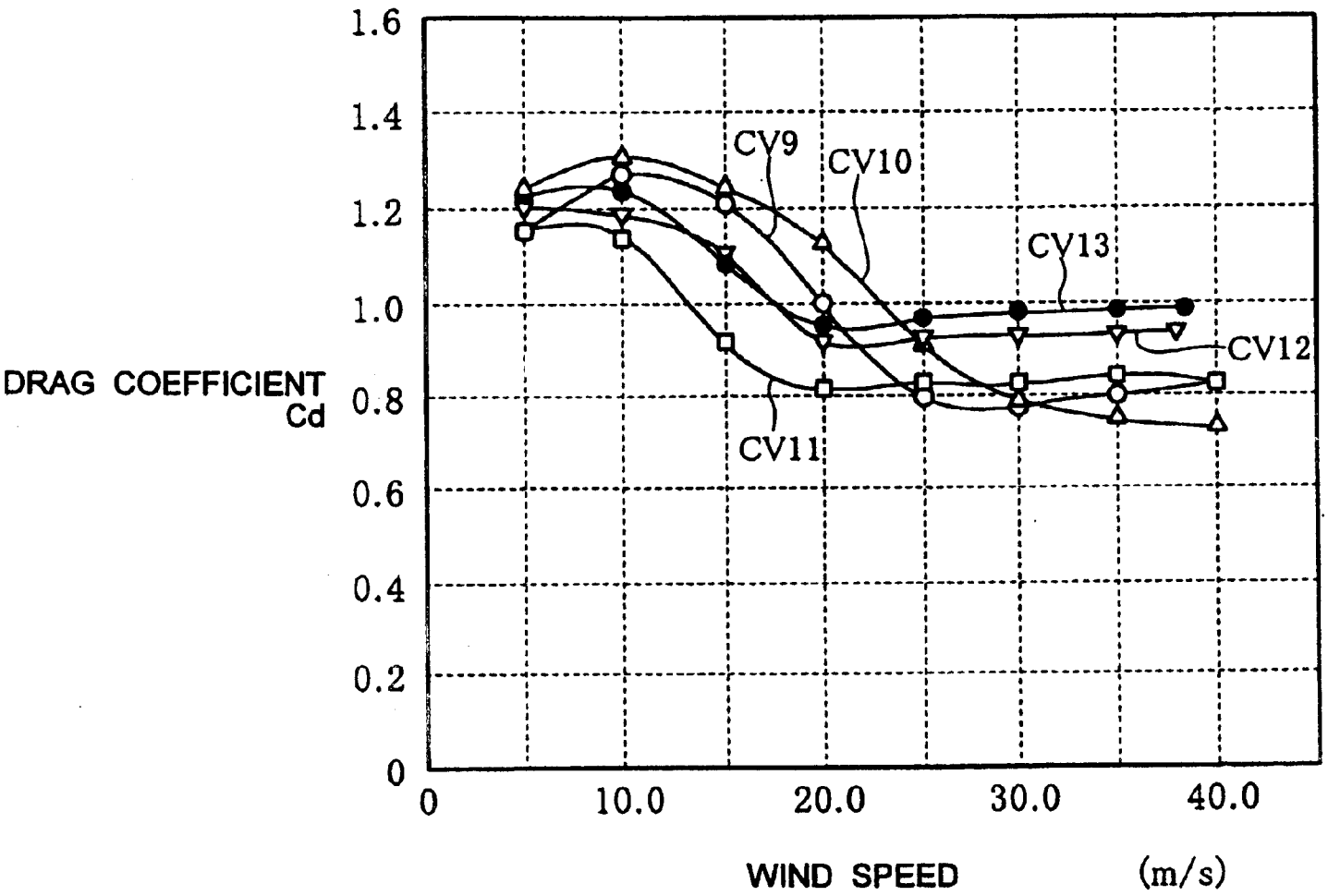
FIG. 9 is a graph of a drag coefficient characteristic of an overhead cable of the present invention and an overhead cable of the related art according to the results of a wind tunnel experiment.

FIG. 9 is a graph of the results of wind tunnel experiments conducted to study the drag reduction characteristics up to the wind speed 40 m/s for the cable 9 to the cable 13.

When investigating the drag coefficient Cd in FIG. 9, in the cable 13 of the related art, as represented by the curve CV13, the drag coefficient Cd reaches the minimum value around the wind speed 20 m/s. Thereafter, the drag coefficient Cd is somewhat increased when the wind speed becomes higher. The drag coefficient Cd becomes almost 1 at the wind speed 40 m/s.

On the other hand, in the cable 9 to the cable 12 of the present invention, as represented by the graphs CV9 to CV12, it is seen that, in the region in which the wind speed exceeds 25 m/s, the effect of reduction of the drag coefficient Cd is obtained compared with the cable 13 of the related art.

At the wind speed with a range from 30 m/s to 40 m/s, as seen from the graph CV10, it is seen that the effect of reduction of the drag coefficient Cd in the cable 10 is especially large.

From this result, in a cable having a diameter of about 27 mm to 29 mm and 12 segment strands, it is seen that the effect of reduction of the drag coefficient Cd at the wind speed within a range from 30 m/s to 40 m/s is especially large if the ratio of H/R is less than about 0.2.

Figure 10:
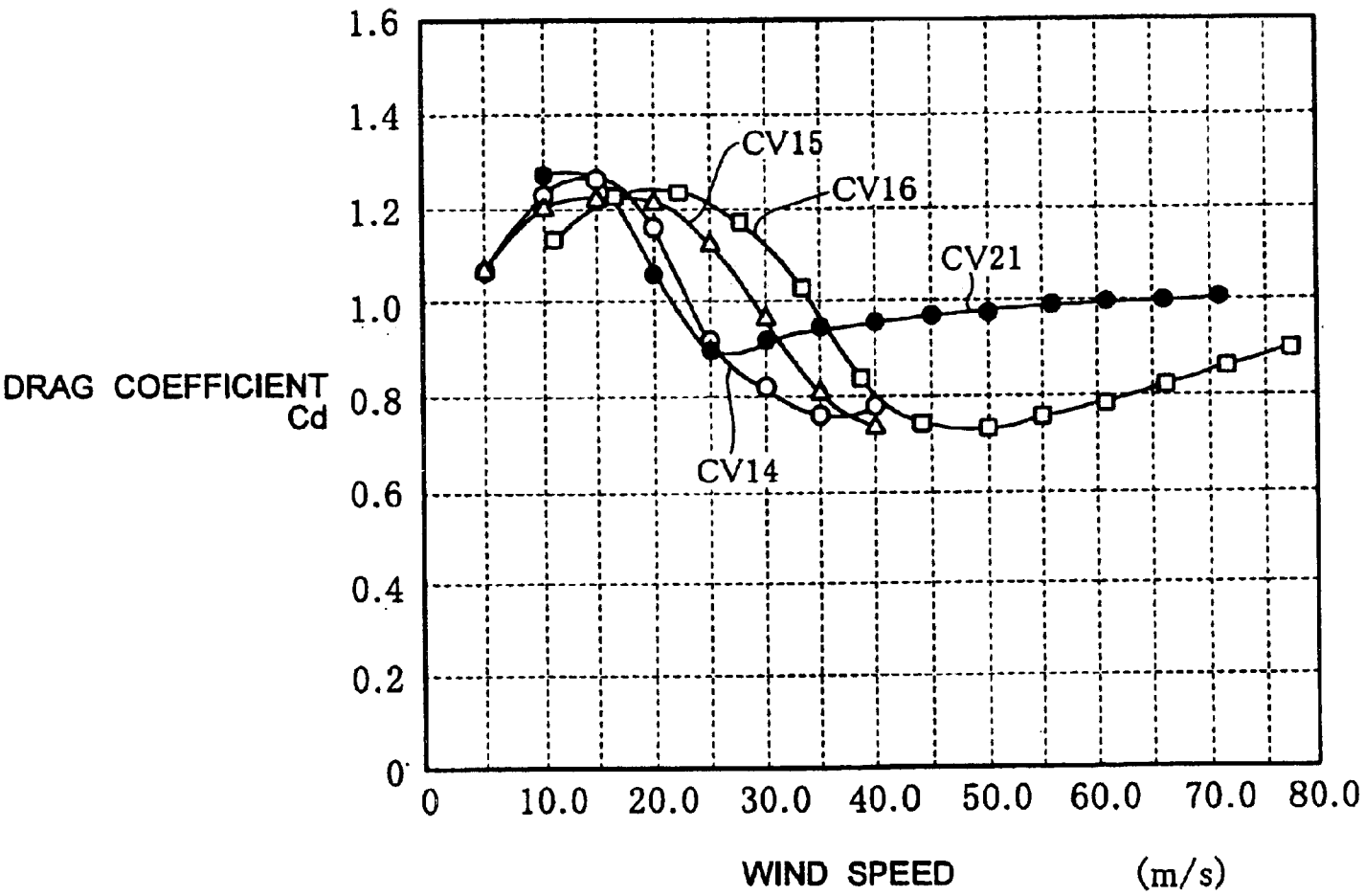
FIG. 10 is a graph of a drag coefficient characteristic of an overhead cable of the present invention and an overhead cable of the related art according to the results of a wind tunnel experiment.

FIG. 10 is a graph showing the results of wind tunnel experiments conducted to study the drag reduction characteristics up to the wind speed 80 m/s for the cable 14 to the cable 16 and the cable 21.

When investigating the drag coefficient Cd in FIG. 10, in the cable 21 of the related art, as represented by the curve CV21, the drag coefficient Cd reaches the minimum value around the wind speed 25 m/s. Thereafter, the drag coefficient Cd is somewhat increased when the wind speed becomes higher. The drag coefficient Cd becomes almost 1 at the wind speed 70 m/s.

On the other hand, in the cable 14 of the present invention, it is seen that the effect of reduction of the drag coefficient Cd is obtained in the region exceeding the wind speed 30 m/s. In the cable 15 of the present invention, as represented by the curve CV15, it is seen that the effect of reduction of the drag coefficient Cd is obtained in the region exceeding the wind speed 35 m/s. In the cable 16 of the present invention, as represented by the curve CV16, it is seen that the effect of reduction of the drag coefficient Cd is obtained in the region exceeding the wind speed 40 m/s.

Namely, when comparing the cables 14 to 16 of the present invention, it is seen that the wind speed at which the effect of reduction of the drag coefficient Cd is obtained varies according to the change of H/R.

Also, when the diameter becomes relatively smaller, it is seen that the effect of reduction of the drag coefficient Cd at the speed within a range from 30 m/s to 40 m/s is larger the value of H/R becomes larger.

Figure 11:
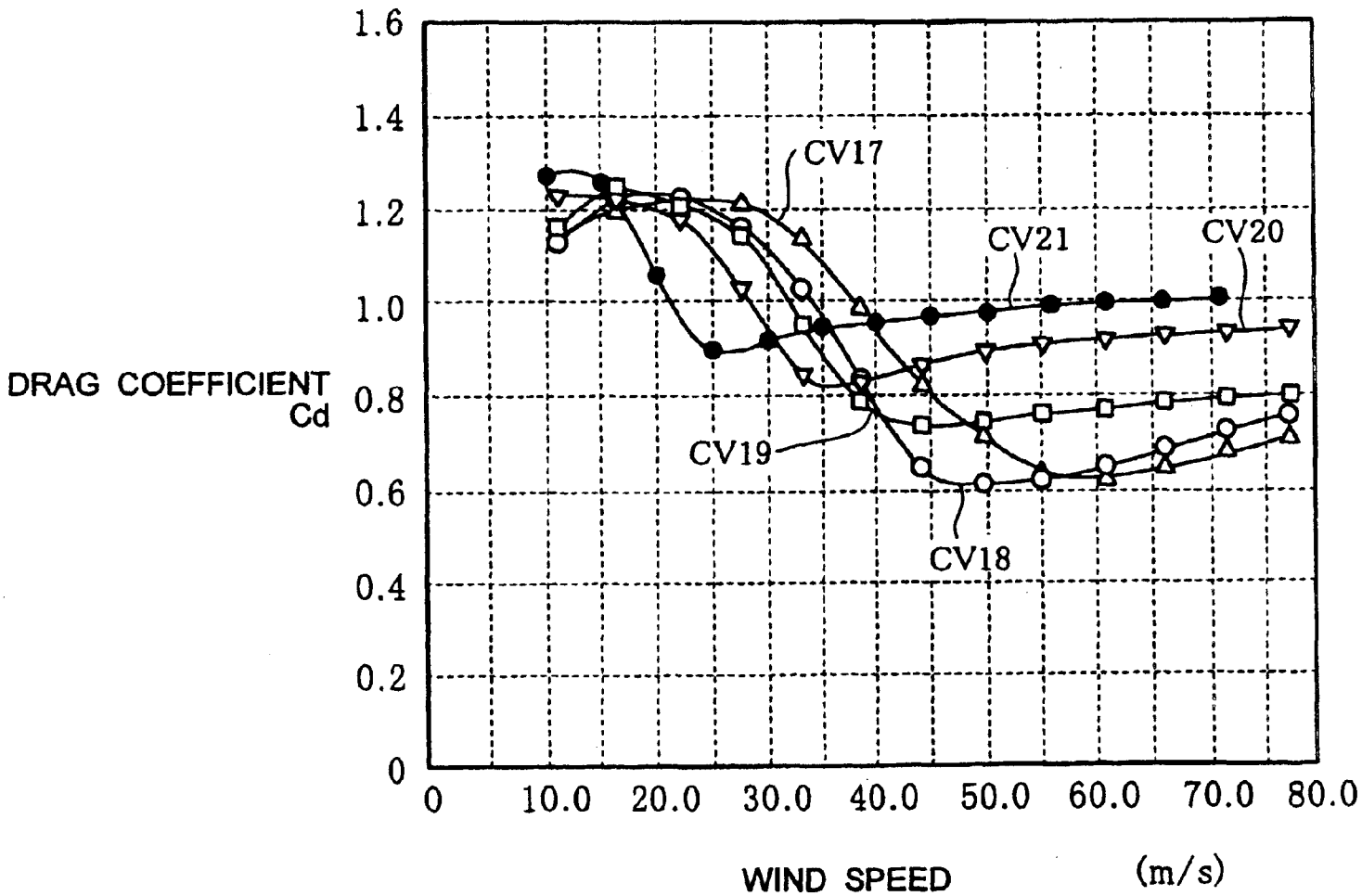
FIG. 11 is a graph of a drag coefficient characteristic of an overhead cable of the present invention and an overhead cable of the related art according to the results of a wind tunnel experiment.

From the result, in a cable having a diameter of about 21 mm to 23 mm and 14 segment strands is especially large if the ratio H/R is larger than about 0.5. FIG. 11 is a graph showing the results of wind tunnel experiments conducted to study the drag coefficient characteristics up to the wind speed 80 m/s for the cable 17 to the cable 21.

Note that the cable 17 of the present invention is a cable having no recess in the outer circumferential surface of the segment strands, while the cables 18 to 20 of the present invention are cables in which there is a recess in the outer circumferential surface of the segment strands. The other design values are the same.

When investigating the drag coefficient Cd in FIG. 11, in the cable 17 to the cable 20 of the present invention, as represented by the graphs CV17 to CV20, it is seen that there is a difference in the characteristic of reduction of the drag coefficient Cd according to the existence of the recess in the outer circumferential surface of the segment strands.

Namely, in the cable 17 of the present invention in which there is no recess in the outer circumferential surface of the segment strands, the effect of reduction of the drag coefficient Cd is obtained in the region exceeding the wind speed 50 m/s, but in the cable <18>to the cable 20 of the present invention in which the recess exists in the outer circumferential surface of the segment strands, it is seen that the effect of reduction of the drag coefficient Cd is obtained even at a wind speed lower than the wind speed 50 m/s.

Further, it is also seen that the characteristic of reduction of the drag coefficient Cd varies according to the size of the maximum depth D of the recess in the outer circumferential surface of the segment strands.

The test results are shown arranged by the number of the segment strands in Table 1, arranged by H/d in Table 2, arranged by H/R in Table 3, and arranged by D/d in Table 4.

TABLE 1

| Cable diameter d | Number of strands | Groove radius R | Groove height H | Depth D | 20 m/s drag coefficient | 30 m/s drag coefficient | 40 m/s drag coefficient |
|---|---|---|---|---|---|---|---|
| 36.6 | 12 | 1.00 | 1.00 | 0.30 | 1.039 | 0.913 | 0.918 |
| 36.6 | 12 | 2.00 | 0.30 | 0.30 | 1.036 | 0.791 | 0.773 |
| 22.0 | 14 | 0.60 | 0.60 | 0.10 | 1.158 | 0.823 | 0.778 |
| 22.0 | 14 | 0.90 | 0.26 | 0.10 | 1.216 | 0.965 | 0.739 |
| 22.0 | 14 | 1.25 | 0.10 | 0.10 | 1.23 | 1.172 | 0.838 |
| 28.0 | 14 | 0.75 | 0.75 | 0.15 | 0.995 | 0.776 | 0.818 |
| 28.0 | 14 | 1.50 | 0.22 | 0.15 | 1.129 | 0.787 | 0.724 |
| 22.0 | 16 | 1.20 | 0.17 | 0.00 | 1.242 | 1.201 | 0.811 |
| 22.0 | 16 | 1.20 | 0.17 | 0.10 | 1.24 | 1.123 | 0.782 |
| 22.0 | 16 | 1.20 | 0.17 | 0.20 | 1.235 | 1.082 | 0.751 |
| 22.0 | 16 | 1.20 | 0.17 | 0.40 | 1.214 | 0.945 | 0.835 |
| 33.0 | 16 | 0.90 | 0.90 | 0.15 | 0.791 | 0.791 | 0.802 |
| 33.0 | 16 | 1.80 | 0.26 | 0.15 | 1.113 | 0.604 | 0.623 |
| 36.6 | 20 | 0.75 | 0.60 | 0.10 | 0.929 | 0.853 | 0.878 |
| 36.6 | 20 | 1.50 | 0.75 | 0.10 | 0.803 | 0.651 | 0.713 |
| 28.0 | 24 | 1.25 | 1.00 | 0.05 | 0.815 | 0.816 | 0.818 |
| 28.0 | 24 | 2.00 | 1.50 | 0.05 | 0.919 | 0.923 | 0.923 |

TABLE 2

| Cable diameter d | Number of strands | Groove radius R | Groove height H | Depth D | H/d | 20 m/s drag coefficient | 30 m/s drag coefficient | 40 m/s drag coefficient |
|---|---|---|---|---|---|---|---|---|
| 22.0 | 14 | 1.25 | 0.10 | 0.10 | 0.0045 | 1.23 | 1.172 | 0.838 |
| 22.0 | 16 | 1.20 | 0.17 | 0.00 | 0.0077 | 1.242 | 1.201 | 0.811 |
| 22.0 | 16 | 1.20 | 0.17 | 0.10 | 0.0077 | 1.24 | 1.123 | 0.782 |
| 22.0 | 16 | 1.20 | 0.17 | 0.20 | 0.0077 | 1.235 | 1.082 | 0.751 |
| 22.0 | 16 | 1.20 | 0.17 | 0.40 | 0.0077 | 1.214 | 0.945 | 0.835 |
| 28.0 | 14 | 1.50 | 0.22 | 0.15 | 0.0079 | 1.129 | 0.787 | 0.724 |
| 33.0 | 16 | 1.80 | 0.26 | 0.15 | 0.0079 | 1.113 | 0.604 | 0.623 |
| 36.6 | 12 | 2.00 | 0.30 | 0.30 | 0.0082 | 1.036 | 0.791 | 0.773 |
| 22.0 | 14 | 0.90 | 0.26 | 0.10 | 0.0118 | 1.216 | 0.965 | 0.739 |
| 36.6 | 20 | 0.75 | 0.60 | 0.10 | 0.0164 | 0.929 | 0.853 | 0.878 |
| 36.6 | 20 | 1.50 | 0.75 | 0.10 | 0.0205 | 0.803 | 0.651 | 0.713 |
| 28.0 | 14 | 0.75 | 0.75 | 0.15 | 0.0268 | 0.995 | 0.776 | 0.818 |
| 22.0 | 14 | 0.60 | 0.60 | 0.10 | 0.0273 | 1.158 | 0.823 | 0.778 |
| 33.0 | 16 | 0.90 | 0.90 | 0.15 | 0.0273 | 0.791 | 0.791 | 0.802 |
| 36.6 | 12 | 1.00 | 1.00 | 0.30 | 0.0273 | 1.039 | 0.913 | 0.918 |
| 28.0 | 24 | 1.25 | 1.00 | 0.05 | 0.0357 | 0.815 | 0.816 | 0.818 |
| 28.0 | 24 | 2.00 | 1.50 | 0.05 | 0.0536 | 0.919 | 0.923 | 0.923 |

TABLE 3

| Cable diameter d | Number of strands | Groove radius R | Groove height H | Depth D | H/R | 20 m/s drag coefficient | 30 m/s drag coefficient | 40 m/s drag coefficient |
|---|---|---|---|---|---|---|---|---|
| 22.0 | 14 | 1.25 | 0.10 | 0.10 | 0.0800 | 1.23 | 1.172 | 0.838 |
| 22.0 | 16 | 1.20 | 0.17 | 0.00 | 0.1417 | 1.242 | 1.201 | 0.811 |
| 22.0 | 16 | 1.20 | 0.17 | 0.10 | 0.1417 | 1.24 | 1.123 | 0.782 |
| 22.0 | 16 | 1.20 | 0.17 | 0.20 | 0.1417 | 1.235 | 1.082 | 0.751 |
| 22.0 | 16 | 1.20 | 0.17 | 0.40 | 0.1417 | 1.214 | 0.945 | 0.835 |
| 33.0 | 16 | 1.80 | 0.26 | 0.15 | 0.1444 | 1.113 | 0.604 | 0.623 |
| 28.0 | 14 | 1.50 | 0.22 | 0.15 | 0.1467 | 1.129 | 0.787 | 0.724 |
| 36.6 | 12 | 2.00 | 0.30 | 0.30 | 0.1500 | 1.036 | 0.791 | 0.773 |
| 22.0 | 14 | 0.90 | 0.26 | 0.10 | 0.2889 | 1.216 | 0.965 | 0.739 |
| 36.6 | 20 | 1.50 | 0.75 | 0.10 | 0.5000 | 0.803 | 0.651 | 0.713 |
| 28.0 | 24 | 2.00 | 1.50 | 0.05 | 0.7500 | 0.919 | 0.923 | 0.923 |
| 36.6 | 20 | 0.75 | 0.60 | 0.10 | 0.8000 | 0.929 | 0.853 | 0.878 |
| 28.0 | 14 | 1.25 | 1.00 | 0.05 | 0.8000 | 0.815 | 0.816 | 0.818 |
| 22.0 | 14 | 0.60 | 0.60 | 0.10 | 1.0000 | 1.158 | 0.823 | 0.778 |
| 28.0 | 14 | 0.75 | 0.75 | 0.15 | 1.0000 | 0.995 | 0.776 | 0.818 |
| 33.0 | 16 | 0.90 | 0.90 | 0.15 | 1.0000 | 0.791 | 0.791 | 0.802 |
| 36.6 | 12 | 1.00 | 1.00 | 0.30 | 1.0000 | 1.039 | 0.913 | 0.918 |

TABLE 4

| Cable diameter d | Number of strands | Groove radius R | Groove height H | Depth D | D/d | 20 m/s drag coefficient | 30 m/s drag coefficient | 40 m/s drag coefficient |
|---|---|---|---|---|---|---|---|---|
| 22.0 | 16 | 1.20 | 0.17 | 0.00 | 0.0000 | 1.242 | 1.201 | 0.811 |
| 28.0 | 24 | 1.25 | 1.00 | 0.05 | 0.0018 | 0.815 | 0.816 | 0.818 |
| 28.0 | 24 | 2.00 | 1.50 | 0.05 | 0.0018 | 0.919 | 0.923 | 0.923 |
| 36.6 | 20 | 0.75 | 0.60 | 0.10 | 0.0027 | 0.929 | 0.853 | 0.878 |
| 36.6 | 20 | 1.50 | 0.75 | 0.10 | 0.0027 | 0.803 | 0.651 | 0.713 |
| 33.0 | 16 | 0.90 | 0.90 | 0.15 | 0.0045 | 0.791 | 0.791 | 0.802 |
| 33.0 | 16 | 1.80 | 0.26 | 0.15 | 0.0045 | 1.113 | 0.604 | 0.623 |
| 22.0 | 14 | 1.25 | 0.10 | 0.10 | 0.0045 | 1.23 | 1.172 | 0.838 |
| 22.0 | 14 | 0.60 | 0.60 | 0.10 | 0.0045 | 1.158 | 0.823 | 0.778 |
| 22.0 | 14 | 0.90 | 0.26 | 0.10 | 0.0045 | 1.216 | 0.965 | 0.739 |
| 22.0 | 16 | 1.20 | 0.17 | 0.10 | 0.0045 | 1.24 | 1.123 | 0.782 |
| 28.0 | 14 | 0.75 | 0.75 | 0.15 | 0.0054 | 0.995 | 0.776 | 0.818 |
| 28.0 | 14 | 1.50 | 0.22 | 0.15 | 0.0054 | 1.129 | 0.787 | 0.724 |
| 36.6 | 12 | 1.00 | 1.00 | 0.30 | 0.0082 | 1.039 | 0.913 | 0.918 |
| 26.6 | 12 | 2.00 | 0.30 | 0.30 | 0.0082 | 1.036 | 0.791 | 0.773 |
| 22.0 | 16 | 1.20 | 0.17 | 0.20 | 0.0091 | 1.235 | 1.082 | 0.751 |
| 22.0 | 16 | 1.20 | 0.17 | 0.40 | 0.0182 | 1.214 | 0.945 | 0.835 |

Table 1 shows the relationship between the number of the segment strands and the effect of reduction of the drag coefficient. According to Table 1, at the wind speed 40 m/s, it is seen that the effect of reduction of the drag coefficient, that is, the reduction of the wind load, is obtained within a range from a regular 12-sided polygon to a regular 24-sided polygon (preferably within a range from a regular 14-sided polygon to a regular 20-sided polygon).

Table 2 shows the relationship between the H/d and the effect of reduction of the drag coefficient. According to Table 2, it is seen that, at the wind speed 40 m/s, the effect of reduction of the wind load is obtained when H/d is within the range from 0.0045 to 0.0357 (preferably within a range from 0.0077 to 0.0205).

Table 3 shows the relationship between the H/R and the effect of reduction of the drag coefficient. According to Table 3, it is seen that, at the wind speed 40 m/s, the effect of reduction of the wind load is obtained when H/R is within the range from 0.08 to 1.0 (preferably within a range from 0.14 to 0.50).

Table 4 shows the relationship between the D/d and the effect of reduction of the drag coefficient. According to Table 4, it is seen that, at the wind speed 40 m/s, the effect of reduction of the wind load is obtained when D/d is within a range not more than 0.0182 (preferably in a range not more than 0.0091). Particularly in a cable having a diameter of 22 mm, it is seen that, if D/d becomes 0.0045 or less, a large wind load reduction effect is created in the design wind speed zone.

The above experiments were carried out for cables having the diameters of 22 to 36.6 mm.

According to the results of experiments shown in FIG. 7 to FIG. 11, it is clear that, in the case of the design wind speed 40 m/s of a general overhead cable, the effect of the reduction of the wind load is obtained within the range of diameters described above.

Further, when the ranges of the thickness of the cables in which the effect of the present invention is obtained are sought by using the Reynolds number Re=Ud/u (U: wind speed, d: outer diameter of the cable, u: standard atmospheric state or $1.473\times10^{-5}$), the following ranges are obtained.

According to the results of the experiments shown in FIG. 11, it is apparent that the effect of reduction of the wind speed is obtained where the wind speed is within a range from 35 to 77.5 m/s in the cable 17 to the cable 20 of the present invention having the diameter of 22 mm.

By this, when seeking the minimum outer diameter d1 and the maximum outer diameter d2 of the cables exhibiting the wind load reduction effect by using the Reynolds number Re, they are as follows.

Case where the design wind speed is 40 m/s

Re=35×22/u=40×d1/u, accordingly d1=19.3 mm

Re=77.5×22/u=40×d2/u, accordingly d2=42.6 mm

Case where the design wind speed is 50 m/s (mountainous district etc.)

Re=35×22/u=50×d1/u, accordingly d1=15.4 mm

Re=77.5×22/u=50×d2/u, accordingly d2=34.1 mm

Case where the design wind speed is 60 m/s (isle such as Okinawa etc.)

Re=35×22/u=60×d1/u, accordingly d1=12.8 mm

Re=77.5×22/u=60×d2/u, accordingly d2=28.4 mm

Accordingly, in the cables of the present invention, though depending on the design wind speed, it is possible to reduce the wind load within a range of diameters from 12.8 to 42.6 mm, preferably within a range from 15.4 to 42.6 mm.

The overhead cables according to the embodiments were steel-reinforced aluminum cables, but the overhead cable of the present invention relates to the sectional shape of the cables, so it can be similarly applied to also copper cable, overhead ground wires, and covered cables.

Further, similar effects are obtained even if using, instead of the tension-bearing steel core of the cable, superior temperature elongation characteristic Invar wire, silicon carbide filaments, carbon fiber, alumina fiber, or aramide fiber plated or coated on the surface with aluminum, zinc, chromium, copper, or the like.

As explained above, according to the present invention, by making the sectional shape of the cable a regular polygon and arranging arc-shaped grooves in the vertex portions, the reduction of the wind load of a small sized cable, which was never achieved in the related art, becomes possible.

Further, according to the present invention, the outermost layer can be constituted by a single type of segment strand having a simple shape, therefore a wind load cable can be provided at low cost without a special manufacturing technique or an increase of costs.

What is claimed is:

1. An overhead cable comprising:

a tension-bearing core;

a conductive layer arranged at an outer circumference of the core; and an outermost layer constituted by twisting together a plurality of segment strands and a plurality of grooves, each positioned at each boundary portion of adjoining segment strands, the segments and the grooves being spiraled along the longitudinal direction of the cable;

wherein the outer surface of each segment strand has a flat surface forming a side of a regular polygon or an arc-shaped curve surface dented from the flat surface;

wherein each groove comprises an arc-shaped curve having a predetermined radius R centered about a vertex of the regular polygon and recessed from the outer surface of adjoining segment strands; and wherein a connecting portion between an end of the outer surface of the segment strand and a most projected portion of the groove has a crooked shape having an acute angle.

2. An overhead cable as set forth claim 1, wherein a diameter d of a circle circumscribing the vertex of the regular polygon is within a range from 12.8 mm to 42.6 mm.

3. An overhead cable as set forth claim 2, wherein said regular polygon is made within a range from a regular 12-sided polygon to a regular 24-sided polygon.

4. An overhead cable as set forth claim 3, wherein said arc-shaped curve is concave with respect to the straight line connecting adjoining vertexes of the regular polygon by a maximum depth D and a ratio D/d between the maximum depth D and the diameter d of circumscribing the vertexes of the regular polygon is within a range from 0.0 to 0.018.

5. An overhead cable as set forth claim 4, wherein a ratio H/d between a maximum height H from a vertex of said regular polygon to the bottom of said groove and said diameter d is within a range from 0.0045 to 0.0357.

6. An overhead cable comprising:

a tension-bearing core;

a conductive layer arranged at an outer circumference of the core; and an outermost layer constituted by twisting together a plurality of segment strands and a plurality of grooves, each positioned at each boundary portion of adjoining segment strands, the segments and the grooves being spiraled along the longitudinal direction of the cable;

wherein the outer surface of each segment strand has a flat surface forming a side of a regular polygon or an arc-shaped curve surface dented from the flat surface, each groove comprises an arc-shaped curve having a predetermined radius R centered about vertex of the regular polygon and recessed from the outer surface of adjoining segment strands, and a connecting portion between an end of the outer surface of the segment strand and the most projected portion of the groove has a crooked shape having an acute angle;

wherein a diameter d of a circle circumscribing the vertex of the regular polygon is within a range from 12.8 mm to 42.6 mm;

wherein said regular polygon is made within a range from a regular 12-sided polygon to a regular 24-sided polygon;

wherein flat surface or arc-shaped curve is concave with respect to a straight line connecting adjoining vertexes of the regular polygon by a maximum depth D and a ratio D/d between maximum depth D and the diameter d of circumscribing the vertexes of the regular polygon is within a range from 0.0 to 0.018;

wherein a ratio H/d between a maximum height H from a vertex of said regular polygon to the bottom of said groove and said diameter d is within a range from a 0.0045 to 0.0357; and wherein a ratio H/R between said maximum height and said radius R is within a range from 0.08 to 1.0.

7. An overhead cable as set forth claim 6, wherein said diameter d is within a range from 35 mm to 38 mm, the number of said segment strands is 12, and said ratio H/R is less than 0.2.

8. An overhead cable as set forth claim 6, wherein said diameter d is within a range from 35 mm to 38 mm, and the number of said segment strands is 20 and said ratio H/R is less than 0.6.

9. An overhead cable as set forth claim 6, wherein said diameter d is within a range from 32 mm to 34 mm, the number of said segment strands is 16 and said ratio H/R is less than 0.4.

10. An overhead cable as set forth in claim 6, wherein said diameter d is within a range from 27 mm to 29 mm, the number of said segment strands is 14, and said ratio H/R is less than 0.02.

11. An overhead cable as set forth claim 6, wherein said diameter d is within a range from 21 mm to 23 mm, the number of said segment strands is 14 and the ratio H/R is more than 0.5.

12. An overhead cable comprising:

a tension-bearing core;

a conductive layer arranged at an outer circumference of the core;

an outermost layer formed by twisting together a plurality of segment strands, and having a spiral groove along the longitudinal direction in the outer circumferential surface region of a boundary portion of each adjoining segment strand, wherein in the contour of the cross-section of said outermost layer, each spiral groove comprises an arc-shaped curve having a predetermined radius R centered about one of a plurality of vertexes of a regular polygon;

wherein the intersection between sides of each of the spiral grooves and the outer contour of the segment strands between said spiral grooves defines a sharp, substantially discontinuous edge; and wherein a diameter d of a circle circumscribing the vertexes of the regular polygon is within a range from 35 mm to 38 mm, the number of said segment strands is 12, and a ratio H/R, of a maximum height H from one of the plurality of vertexes of the regular polygon to the bottom of the spiral groove centered about the vertex and the radius R, is less than 0.2.

* * * * *